US008764460B2

(12) United States Patent
Smink et al.

(10) Patent No.: US 8,764,460 B2
(45) Date of Patent: Jul. 1, 2014

(54) ELECTRICAL CONNECTOR WITH GROUNDING BAR

(75) Inventors: Rutger Wilhelmus Smink, Hamont-Achel (BE); Lieven Decrock, Roeslare (BE); Jacobus Nicolaas Tuin, Best (NL)

(73) Assignees: TE Connectivity Nederland B.V., 'S-Hertogenbosch (NL); Tyco Electronics Belgium EC BVBA, Oostkamp (BE)

( * ) Notice: Subject to any disclaimer, the term of this patent is extended or adjusted under 35 U.S.C. 154(b) by 61 days.

(21) Appl. No.: 13/530,855

(22) Filed: Jun. 22, 2012

(65) Prior Publication Data

US 2013/0005164 A1 Jan. 3, 2013

(30) Foreign Application Priority Data

Jun. 29, 2011 (EP) ..... 11171936

(51) Int. Cl.
*H01R 4/66* (2006.01)

(52) U.S. Cl.
USPC ..... 439/92

(58) Field of Classification Search
USPC ..... 439/92, 629, 637, 607.11
See application file for complete search history.

(56) References Cited

U.S. PATENT DOCUMENTS

| | | | | |
|---|---|---|---|---|
| 4,975,069 | A | 12/1990 | Fedder et al. | |
| 5,066,236 | A | 11/1991 | Broeksteeg | |
| 5,104,341 | A | 4/1992 | Gilissen et al. | |
| 5,286,212 | A | 2/1994 | Broeksteeg | |
| 5,342,211 | A | 8/1994 | Broeksteeg | |
| 5,380,216 | A | 1/1995 | Broeksteeg et al. | |
| 5,522,730 | A | 6/1996 | Soes et al. | |
| 8,167,631 | B2 * | 5/2012 | Ito et al. | 439/108 |
| 8,342,886 | B2 * | 1/2013 | Zhang et al. | 439/660 |
| 8,353,726 | B2 * | 1/2013 | Zhang et al. | 439/629 |
| 2009/0221165 | A1 | 9/2009 | Buck et al. | |
| 2011/0189895 | A1 * | 8/2011 | Ito et al. | 439/629 |
| 2011/0269346 | A1 * | 11/2011 | Casher et al. | 439/626 |
| 2012/0282808 | A1 * | 11/2012 | Luo et al. | 439/607.28 |

OTHER PUBLICATIONS

European Search Report issued by the European Patent Office—The Hague, dated Oct. 10, 2011, for European Patent Application No. EP 11171936.5; 7 pages.

* cited by examiner

*Primary Examiner* — Hae Moon Hyeon
(74) *Attorney, Agent, or Firm* — Faegre Baker Daniels LLP

(57) ABSTRACT

An electrical connector has a first row of contact pins. The first row of contact pins comprises a first grounding pin, a second grounding pin and a first signal pin arranged between the first grounding pin and the second grounding pin. A grounding bar electrically connects the first grounding pin and the second grounding pin.

15 Claims, 7 Drawing Sheets

Fig. 3 (State of the Art)

ELECTRICAL CONNECTOR WITH GROUNDING BAR

BACKGROUND OF THE INVENTION

1. Field of the Invention

The present invention relates to an electrical connector for data communication purposes.

2. Related Art to the Invention

Electrical connectors of various designs and for various purposes are known in the state of the art. Electrical connectors may for example be used for digital data transmission. For data communication purposes, high data rates are desirable. Furthermore, it is desirable to provide electrical connectors with small form factors, particularly for applications in spatially restricted environments.

SUMMARY OF INVENTION

In electrical connectors which are designed for high data rates, cross-talk between adjacent conductor pairs of the electrical connector is a pivotal parameter. Particularly, resonances in the cross-talk plot are harmful for the performance of the electrical connector at the specific resonance frequencies. It is known in the state of the art to separate differential transmission (Tx) and reception (Rx) pairs by ground contacts to reduce cross-talk. In case of small pitches between neighbouring conductors, resonances however still occur. These resonances severely limit the possibility of increasing data rates in electrical connectors with small form factors.

It is an object of the present invention to provide an electrical connector that allows for increased data rates. This objective is achieved by an electrical connector according to claim 1. Preferred embodiments are disclosed in the dependent claims.

An electrical connector comprises a first row of contact pins, wherein the first row of contact pins comprises a first grounding pin, a second grounding pin and a first signal pin arranged between said first grounding pin and said second grounding pin. A grounding bar furthermore electrically connects said first grounding pin and said second grounding pin. Advantageously, this electrical connector can be implemented with a small form factor. Advantageously, the inclusion of the grounding bar makes sure that the potential build-up due to the inductance of the pins is reduced. The grounding bar makes the LC circuit smaller, hence shifting the resonance frequencies to higher frequencies. Advantageously, this largely improves the electrical performance of the electrical connector on insertion loss, return loss and cross-talk.

Preferably, said grounding bar spans said first signal pin.

Preferably, said grounding bar is electrically isolated from said first signal pin. Advantageously, this avoids a short between the grounding bars and the first signal pin.

According to one embodiment, said grounding bar is made from stamped material. Advantageously, this allows for a simple and cost-effective manufacture of the electrical connector.

According to an alternative embodiment, said grounding bar is formed integrally with said first grounding pin and/or said second grounding pin. Advantageously, this also allows for a simple and cost-effective manufacture of the electrical connector.

In yet another alternative embodiment of the electrical connector, said connector comprises a housing, wherein said housing comprises a section made of plastic material, wherein said grounding bar is formed by a conductive element enclosed in said section. Advantageously, this also allows for an easy and cost-effective manufacture of the electrical connector.

According to a further development, a second signal pin is arranged between said first grounding pin and said second grounding pin. Said first signal pin and said second signal pin are designed for forming a differential signal pair. Advantageously, the electrical connector then allows for differential signalling.

In one embodiment of the electrical connector, a second grounding bar electrically connects said first grounding pin and said second grounding pin. Advantageously, providing more grounding bars shifts the resonances in the cross-talk to even higher frequencies.

Preferably, said second grounding bar is arranged in parallel to said grounding bar. Advantageously, this allows for a space-saving arrangement.

According to another embodiment of the electrical connector, said row of contact pins further comprises a third grounding pin, wherein the grounding bar electrically connects the first grounding pin, the second grounding pin and said third grounding pin. Advantageously, further signal pins may then be provided between the second grounding pin and the third grounding pin.

According to an alternative embodiment of the electrical connector, said row of contact pins further comprises a third grounding pin, wherein a third grounding bar electrically connects said second grounding pin and said third grounding pin. Advantageously, further signal pins of the electrical connector can then be arranged between the second grounding pin and the third grounding pin.

According to one embodiment, said grounding bar and said third grounding bar are arranged at different longitudinal positions of said second grounding pin. Advantageously, the grounding bar and the third grounding bar can then both connect to the second grounding pin without abutting against each other.

According to a further development of the electrical connector, the connector comprises a second row of pins arranged in parallel to said first row of contact pins. Advantageously, the electrical connector then allows transferring a higher number of data signals in parallel.

Preferably, the connector is adapted for contacting an edge connector.

BRIEF DESCRIPTION OF THE DRAWINGS

The invention will now be explained in more detail with reference to the figures, in which:

FIG. 1 shows a perspective view of a first electrical connector 100 according to a first embodiment. The first electrical connector 100 may for example be used for digital data transmission at high data rates. The first electrical connector 100 may for example use differential signalling for transferring digital data.

In FIG. 1, the first electrical connector 100 is depicted without a housing for the sake of clarity. FIG. 7 schematically depicts the first electrical connector 100 including its housing and will be explained below. The first electrical connector 100 comprises a connector base 130 shown in FIG. 1. The connector base 130 may be an integral part of the housing of the first electrical connector 100 or it may be a separate component.

DETAILED DESCRIPTION OF THE INVENTION

Figure 1:
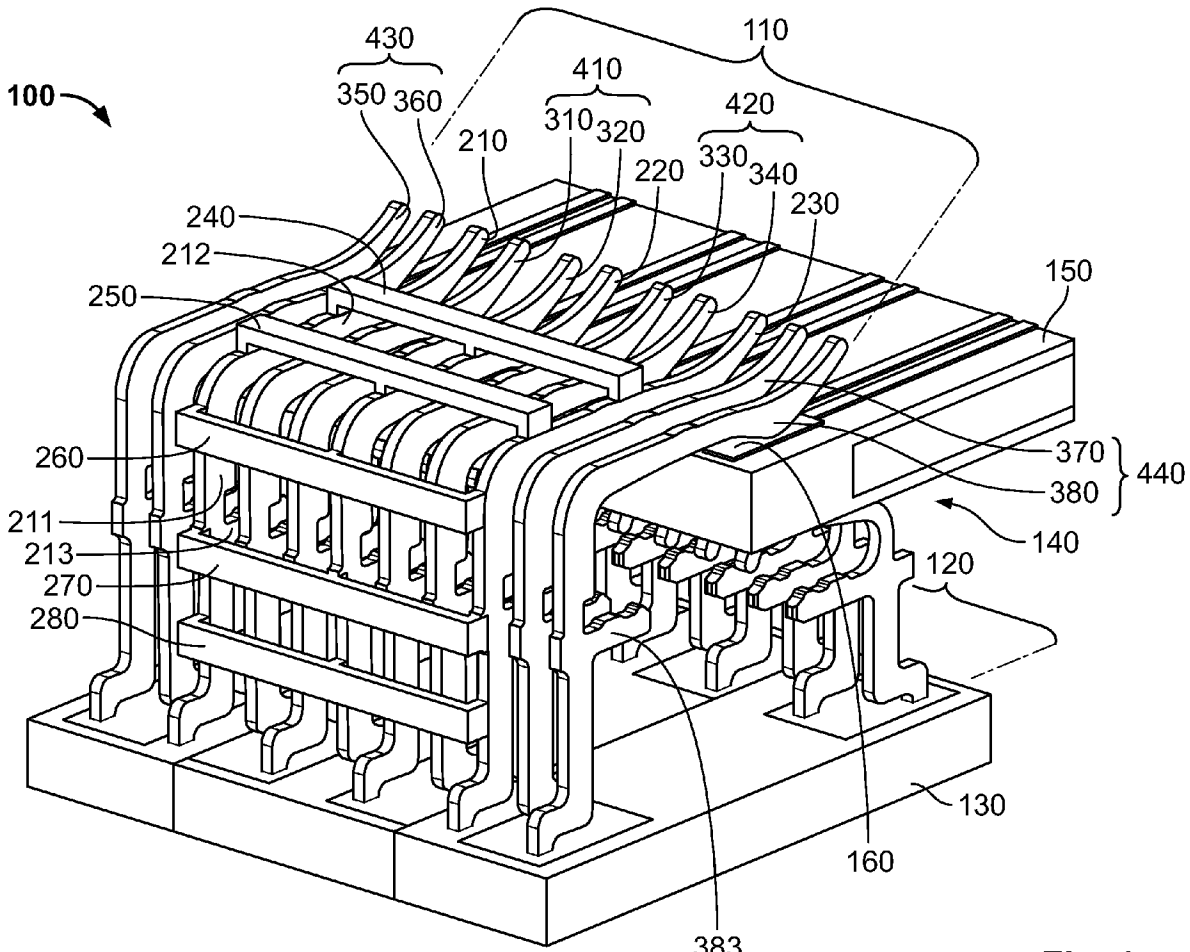
FIG. 1 shows an electrical connector according to a first embodiment.

The first electrical connector 100 comprises a first row 110 of contact pins and a second row 120 of contact pins. The first row 110 of contact pins and the second row 120 of contact pins are arranged on the connector base 130. The first row 110 of contact pins and the second row 120 of contact pins are arranged in parallel to each other. Between the first row 110 of contact pins and the second row 120 of contact pins, the first electrical connector 100 comprises a socket slot 140 for receiving a mating electrical connector for connecting to the first electrical connector 100. The mating electrical connector may for example comprise a printed circuit board 150 with an edge connector 160, as schematically depicted in FIG. 1.

The first row 110 of contact pins comprises a first grounding pin 210, a second grounding pin 220 and a third grounding pin 230. The first row 110 of contact pins further comprises a first signal pin 310, a second signal pin 320, a third signal pin 330, a fourth signal pin 340, a fifth signal pin 350, a sixth signal pin 360, a seventh signal pin 370 and an eighth signal pin 380.

The first signal pin 310 and the second signal pin 320 are arranged next to each other and form a first differential signal pair 410. The third signal pin 330 and the fourth signal pin 340 are arranged next to each other and form a second differential signal pair 420. The fifth signal pin 350 and the sixth signal pin 360 are arranged next to each other and form a third differential signal pair 430. The seventh signal pin 370 and the eighth signal pin 380 are arranged next to each other and form a fourth differential signal pair 440.

The first grounding pin 210 is arranged between the first differential signal pair 410 and the third differential signal pair 430. The second grounding pin 220 is arranged between the first differential signal pair 410 and the second differential signal pair 420. The third grounding pin 230 is arranged between the second differential signal pair 420 and the fourth differential signal pair 440.

Each differential signal pair 410, 420, 430, 440 may be used for transferring one differential data signal. In the first differential signal pair 410, the first signal pin 310 may for example carry the positive signal and the second signal pin 320 may for example carry the negative signal. Each of the differential signal pairs 410, 420, 430, 440 may be used for receiving or transmitting data.

The second row 120 of contact pins comprises grounding pins and signal pins, as well.

The first grounding pin 210 comprises a first portion 211 and a second portion 212. The first portion 211 of the first grounding pin 210 is arranged approximately perpendicularly to the connector base 130. The second portion 212 is connected to the first portion 211 and is arranged approximately perpendicularly to the first portion 211 and approximately in parallel to the connector base 130. Every other pin of the first row 110 of contact pins is designed analogously to the first grounding pin 210 with a first portion 211 and a second portion 212. The first portions 211 and the second portions 212 may draw an angle of approximately 90° or any other angle.

The first portion 211 of each grounding pin 210, 220, 230 of the first row 210 of contact pins comprises a retention section 213 which extends approximately perpendicularly from the first portion 211 of the respective grounding pin 210, 220, 230. The first portion 211 of each signal pin 310, 320, 330, 340, 350, 360, 370, 380 of the first row 210 of contact pins comprises a retention section 383 which extends approximately perpendicularly from the first portion 211 of the respective signal pin 310, 320, 330, 340, 350, 360, 370, 380. The retention sections 213, 383 serve to fixate the pins of the first row 110 of contact pins in the housing of the first electrical connector 100. The retention sections 213, 383 may also be omitted.

The first electrical connector 100 further comprises a first grounding bar 240, a second grounding bar 250, a third grounding bar 260, a fourth grounding bar 270 and a fifth grounding bar 280. Each of the grounding bars 240, 250, 260, 270, 280 electrically connects the first grounding pin 210, the second grounding pin 220 and the third grounding pin 230. Each grounding bar 240, 250, 260, 270, 280 bridges the first differential signal pair 410 comprising the first signal pins 310 and the second signal pins 320 and the second differential signal pair 420 comprising the third signal pin 330 and the fourth signal pin 320. The grounding bars 240, 250, 260, 270, 280 are thus electrically insulated from the differential signal pairs 410, 420, 430, 440.

The grounding bars 240, 250, 260, 270, 280 are arranged in parallel to each other. The first grounding bar 240 and the second grounding bar 250 are arranged on the second portions 212 of the first grounding pin 210, the second grounding pin 220 and the third grounding pin 230. The third grounding bar 260, the fourth grounding bar 270 and the fifth grounding bar 280 are arranged on the first portions 211 of the first grounding pin 210, the second grounding pin 220 and the third grounding pin 230.

The grounding bars 240, 250, 260, 270, 280 shift the crosstalk resonances between the differential signal pairs 410, 420, 430, 440 of the first electrical connector 100 to higher frequencies. The more grounding bars 240, 250, 260, 270, 280 the first electrical connector 100 comprises, the higher the resonances frequencies become. The first row 110 of contact pins of the first electrical connector 100 may therefore comprise more than five grounding bars 240, 250, 260, 270, 280. On the other hand, fewer than five grounding bars 240, 250, 260, 270, 280 may be provided in case the achieved shift of resonance frequencies is sufficient.

The grounding bars 240, 250, 260, 270, 280 slightly influence the differential signal pairs 410, 420, 430, 440. In case the grounding bars 240, 250, 260, 270, 280 are designed to be small, the influence is, however, small and does not require drastic compensation. Compensation can be effected by changing the width of the signal pins 310, 320, 330, 340, 350, 360, 370, 380 of the differential signal pairs 410, 420, 430, 440, or by changing a housing of the first electrical connector 100.

The grounding bars 240, 250, 260, 270, 280 may for example be formed from stamped material. In the example depicted in FIG. 1, the grounding bars 240, 250, 260, 270, 280 are arranged on an outer side of the grounding pins 210, 220, 230 of the first row 110 of contact pins. The outer side of the grounding pins 210, 220, 230 is defined as the side that faces away from the second row 120 of contact pins of the first electrical connector 100. The grounding bars 240, 250, 260, 270, 280 may, however, also be arranged on an inner side of the first row 110 of contact pins or on the retention sections 213 of the grounding pins 210, 220, 230. The grounding bars 240, 250, 260, 270, 280 may also be formed of springs enclosed in an overhanging plastic section of a housing of the first electrical connector 100.

The second row 120 of contact pins of the first electrical connector 100 also comprises signal pins and grounding pins. The signal pins of the second row 120 of contact pins are grouped into differential signal pairs, as well. Each differential signal pair of the second row 120 of contact pins is separated by a grounding pin of the second row 120 of contact pins of the first electrical connector 100. The grounding pins of the second row 120 of contact pins may or may not be connected with grounding bars, as in the first row 110 of contact pins.

Figure 2:
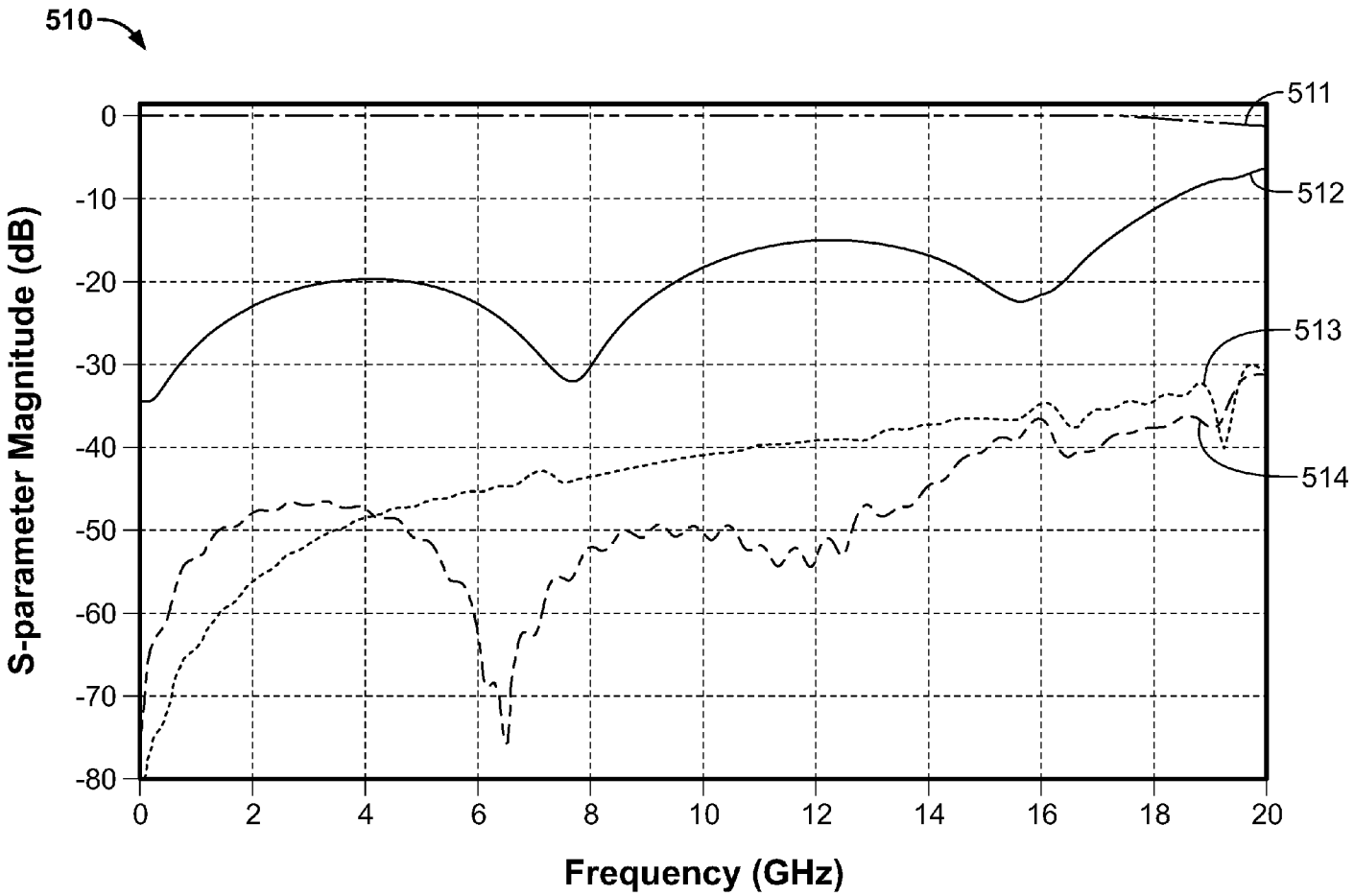
FIG. 2 shows a first cross-talk diagram of the electrical connector according to a first embodiment.
Figure 3:
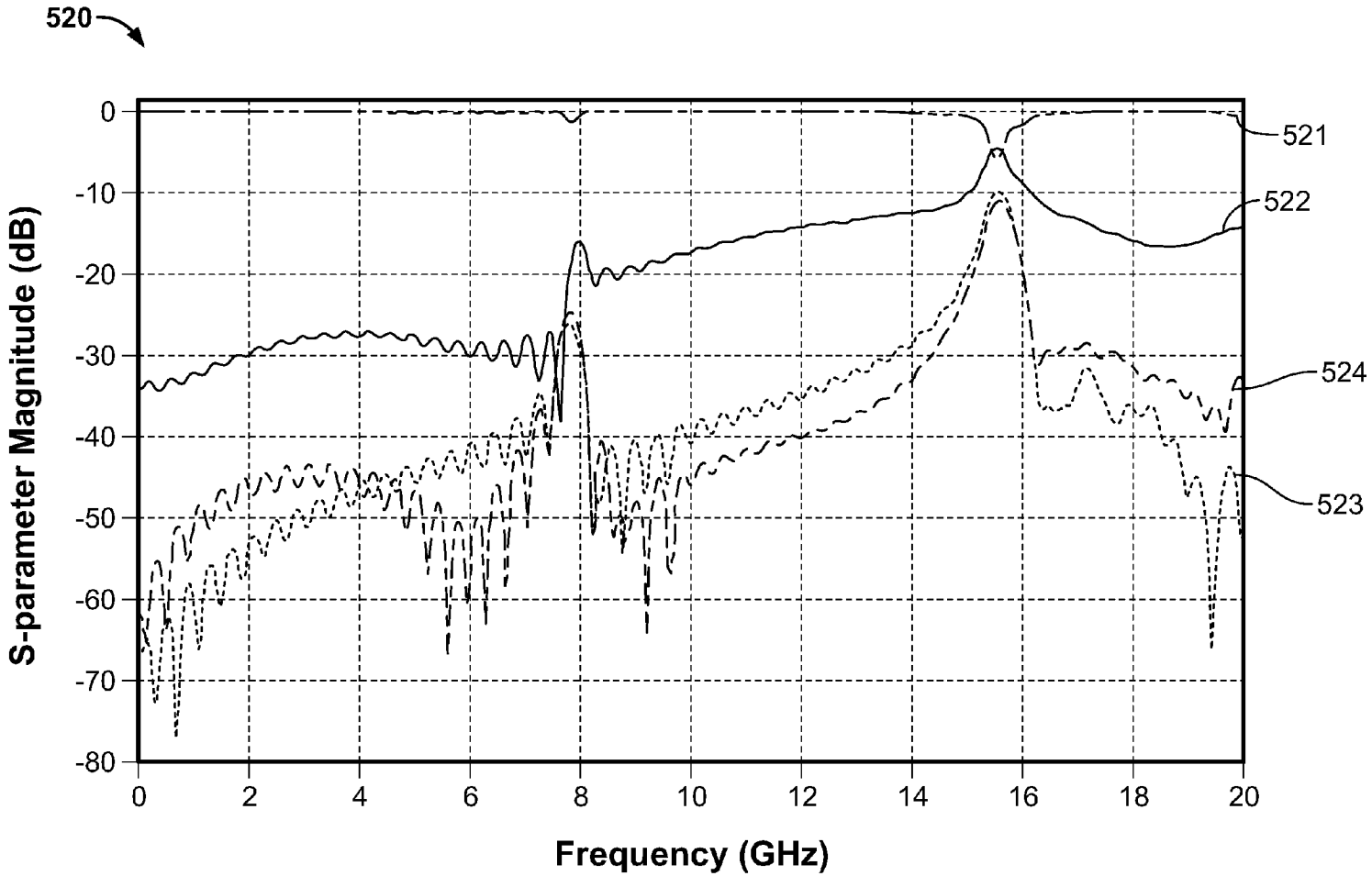
FIG. 3 shows a second cross-talk diagram of an electrical connector according to the state of the art.

FIG. 2 shows a first cross-talk diagram 510 for the first electrical connector 100 of FIG. 1. FIG. 3 shows a second cross-talk diagram 520 for an electrical connector without grounding bars for comparison. Both diagrams 510, 520 depict an S-parameter magnitude in dB as a function of frequency in GHz for various electrical properties of the electrical connector.

In FIG. 2, a first curve 511 depicts an insertion loss, a second curve 512 depicts a return loss, a third curve 513 depicts a far-end cross-talk and a fourth curve 514 depicts a near-end cross-talk. In FIG. 3, a first curve 521 depicts an insertion loss, a second curve 522 depicts a return loss, a third curve 523 depicts a far-end cross-talk and a fourth curve 524 depicts a near-end cross-talk.

The cross-talk curves 513, 514, 523, 524 are especially relevant. Far-end cross-talk 513, 522 relates to cross-talk from one differential signal pair 410, 420, 430, 440 to another differential signal pair 410, 420, 430, 440 at the end of the contact pins of the first row 110 at the socket slot 140. Near-end cross-talk 514, 524 relates to cross-talk between differential signal pairs 410, 420, 430, 440 at the end of the contact pins of the first row 110 near the connector base 130.

FIG. 3 clearly shows a first resonance of the electrical connector without grounding bars 240, 250, 260, 270, 280 at frequencies around 8 GHz and a second resonance at frequencies around 16 GHz. These resonances are harmful to the electrical performance of the electrical connector.

FIG. 2 in comparison shows that the first electrical connector 100 depicted in FIG. 1 does not have resonances at these frequencies of 8 GHz and 16 GHz. The absence of resonances at said frequencies is due to the grounding bars 240, 250, 260, 270, 280. The resonances are shifted to higher frequencies not depicted in the diagrams 510, 520 of FIGS. 2 and 3.

Consequently, the first electrical connector 100 allows for much higher data rates than a conventional electrical connector without grounding bars 240, 250, 260, 270, 280. The first electrical connector 100 may allow for data rates of 25 Gbps or higher. These data rates may be achieved at a pitch of for example 0.6 mm between neighbouring contact pins of the first row 110 of contact pins and a pitch of for example 2 mm to 2.5 mm between neighbouring differential signal pairs 410, 420, 430, 440 of the first row 110 of contact pins.

Figure 4:
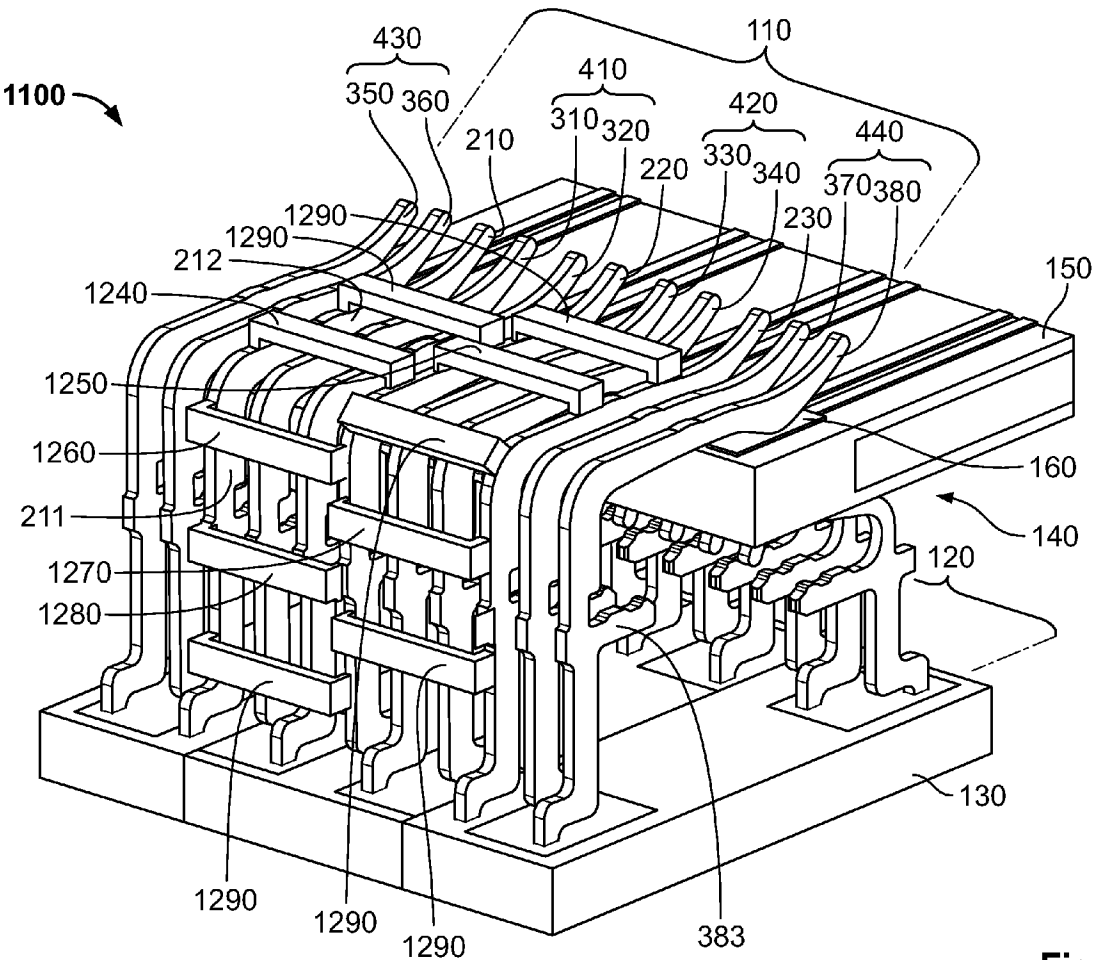
FIG. 4 shows an electrical connector according to a second embodiment.

FIG. 4 depicts a second electrical connector 1100 according to a second embodiment. The construction of the second electrical connector 1100 is similar to the construction of the first electrical connector 100 depicted in FIG. 1. Equivalent components are labelled with the same reference numerals as in FIG. 1 and will not be explained in detail again.

In contrast to the first electrical connector 100 of FIG. 1, the second electrical connector 1100 of FIG. 4 does not comprise grounding bars 240, 250, 260, 270, 280 but comprises a first grounding bar 1240, a second grounding bar 1250, a third grounding bar 1260, a fourth grounding bar 1270, a fifth grounding bar 1280 and further grounding bars 1290.

The first grounding bar 1240 electrically connects the first grounding pin 210 and the second grounding pin 220, bridging the first signal pin 310 and the second signal pin 320 of the first differential signal pair 410. The second grounding bar 1250 electrically connects the second grounding pin 220 and the third grounding pin 230, bridging the third signal pin 330 and the fourth signal pin 340 of the second differential signal pair 420. The third grounding bar 1260 and the fifth grounding bar 1280 also electrically connect the first grounding pin 210 and the second grounding pin 220, bridging the first signal pin 310 and the second signal pin 320 of the first differential signal pair 410. The fourth grounding bar 1270 also electrically connects the second grounding pin 220 and the third grounding pin 230, bridging the third signal pin 330 and the fourth signal pin 340 of the second differential signal pair 420. Further grounding bars 1290 each connect either the first grounding pin 210 and the second grounding pin 220 or the second grounding pin 220 and the third grounding pin 230, bridging either the first signal pin 310 and the second signal pin 320 of the first differential signal pair 410 or the third signal pin 330 and the fourth signal pin 340 of the second differential signal pair 420.

The first grounding bar 1240 and the second grounding bar 1250 are arranged on the second portion 212 of the grounding pins 210, 220, 230 of the first row 110 of contact pins. The third grounding bar 1260, the fourth grounding bar 1270 and the fifth grounding bar 1280 are arranged on the first portions 211 of the grounding pins 210, 220, 230 of the first row 110 of contact pins of the second electrical connector 1100.

The first grounding bar 1240 and the second grounding bar 1250 are both electrically connected to the second grounding pin 220. The first grounding bar 1240 and the second grounding bar 1250 are, however, arranged at different positions in a longitudinal direction of the second grounding pin 220. All grounding bars 1240, 1250, 1260, 1270, 1280, 1290 of the second electrical connector 1100 are staggered in this manner. Advantageously, this prevents the grounding bars 1240, 1250, 1260, 1270, 1280, 1290 from abutting against each other.

The second electrical connector 1100 may, of course, comprise more or fewer grounding bars 1240, 1250, 1260, 1270, 1280, 1290. As the first electrical connector 100, the grounding bars 1240, 1250, 1260, 1270, 1280 may also be arranged at different positions of the first row 110 of contact pins, for example on the retention sections 213.

The second row 120 of contact pins of the second electrical connector 1100 may also be equipped with grounding bars.

Figure 5:
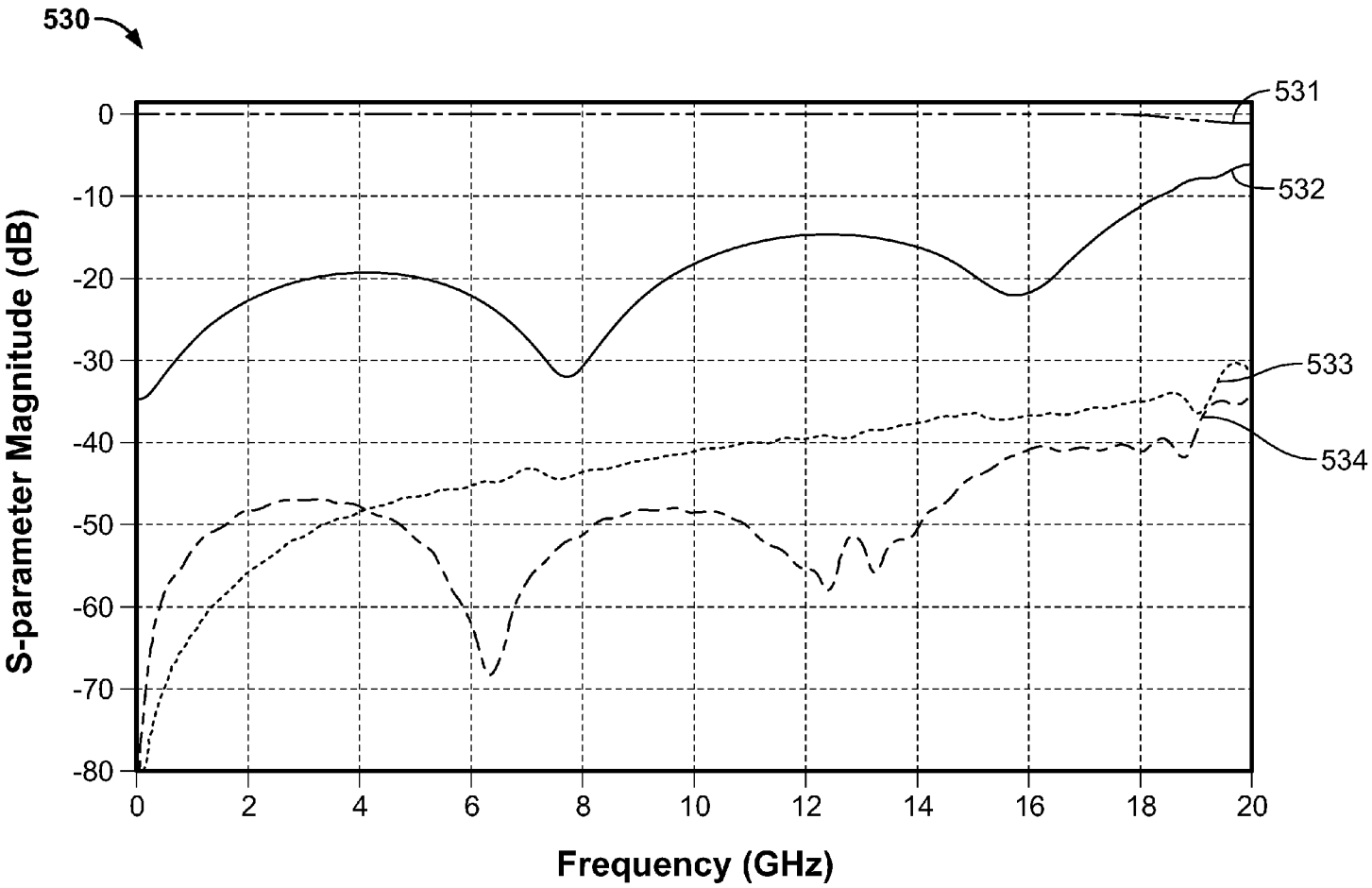
FIG. 5 shows a third cross-talk diagram of the electrical connector according to the second embodiment.

FIG. 5 shows a third cross-talk diagram 530 for the second electrical connector 1100 of FIG. 4. The third cross-talk diagram 530 shows an insertion loss in a first curve 531, a return loss in a second curve 532, a far-end cross-talk in a third curve 533 and a near-end cross-talk in a fourth curve 534. Comparison of the third cross-talk diagram 530 with the first cross-talk diagram 510 of FIG. 2 and the second cross-talk diagram 520 of FIG. 3 reveals that also the second electrical connector 1100 does not comprise cross-talk resonances in the frequencies around 8 GHz and 16 GHz. The cross-talk resonances are again shifted to higher frequencies by means of the grounding bars 1240, 1250, 1260, 1270, 1280.

Figure 6:
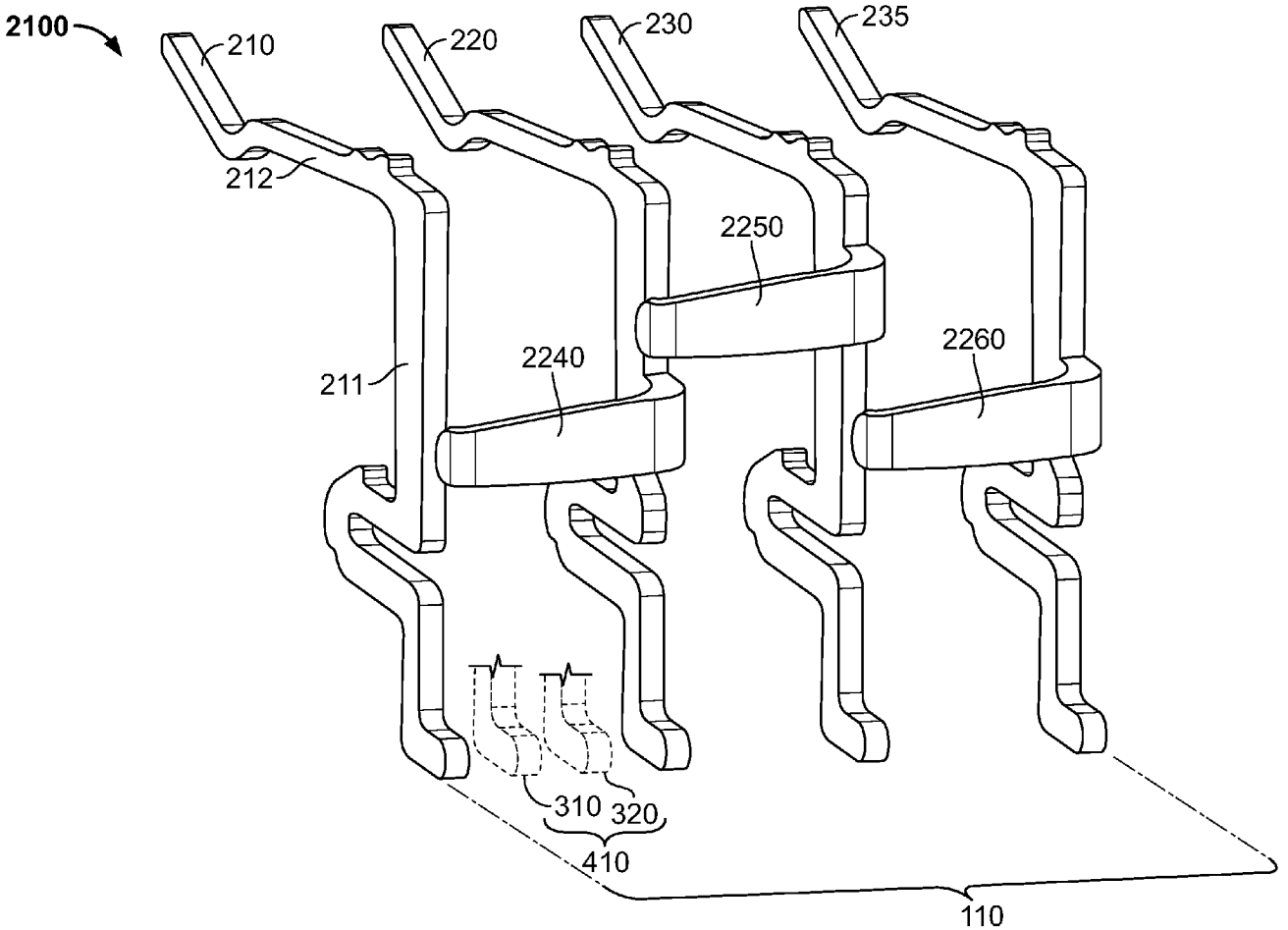
FIG. 6 shows an electrical connector according to a third embodiment.

FIG. 6 schematically depicts a third electrical connector 2100 according to a third embodiment. The construction of the third electrical connector 2100 is similar to the construction of the first electrical connector 100 depicted in FIG. 1 and to the construction of the second electrical connector 1100 depicted in FIG. 4. Equivalent components are labelled with the same reference numerals as in FIG. 1 and will not be explained in detail again. Some components already discussed in the description of the preceding embodiments have been left out in FIG. 6 for clarity reasons.

In contrast to the first electrical connector 100 of FIG. 1, the third electrical connector 2100 of FIG. 6 does not comprise grounding bars 240, 250, 260, 270, 280 but comprises a first grounding bar 2240, a second grounding bar 2250 and a third grounding bar 2260.

The first grounding bar 2240 electrically connects the first grounding pin 210 and the second grounding pin 220, bridging the first signal pin 310 and the second signal pin 320 of the first differential signal pair 410. The second grounding bar 2250 electrically connects the second grounding pin 220 and the third grounding pin 230, bridging the third signal pin 330 and the fourth signal pin 340 of the second differential signal pair 420. The third signal pin 330 and the fourth signal pin 340 of the second differential signal pair 420 are omitted in FIG. 6. The third grounding bar 2260 electrically connects the third grounding pin 230 and a fourth grounding pin 235, bridging further signal pins of a further differential signal pair that is not shown in FIG. 6.

The first grounding bar 2240 and the second grounding bar 2250 are both electrically connected to the second grounding pin 220. The first grounding bar 2240 and the second grounding bar 2250 are, however, arranged at different positions in a longitudinal direction of the second grounding pin 220. Advantageously, this prevents the grounding bars 2240, 2250 from abutting against each other. The third grounding bar 2260 is arranged at the same longitudinal position of the second grounding pin 220 as the first grounding bar 2240. Consequently, the second grounding bar 2250 and the third grounding bar 2260 are arranged at different positions in a longitudinal direction of the third grounding pin 230. Advantageously, this prevents the grounding bars 2250, 2260 from abutting against each other. In an alternative embodiment, all three grounding bars 2240, 2250, 2260 could be arranged at different longitudinal positions of the grounding pins 210, 220, 230, 235.

The first grounding bar 2240 is formed integrally with the second grounding pin 220 and bent to electrically connect the first grounding pin 210. Accordingly, the second grounding bar 2250 is formed integrally with the third grounding pin 230 and bent to electrically connect the second grounding pin 220. The third grounding bar 2260 is formed integrally with the fourth grounding pin 235 and bent to electrically connect the third grounding pin 230. Advantageously, this allows for a simple and cost-efficient manufacture of the third electrical connector 2100.

The third electrical connector 2100 may, of course, comprise more or fewer grounding bars 2240, 2250, 2260.

The grounding bars 1240, 1250, 1260, 1270, 1280 of the second electrical connector 1100 and the grounding bars 2240, 2250, 2260 of the third electrical connector 2100 connect two grounding pins each. The grounding bars 240, 250, 260, 270, 280 of the first electrical connector 100 each connect three grounding pins 210, 220, 230. An electrical connector according to a further embodiment may combine grounding bars connecting two grounding pins with grounding bars connecting three or more grounding pins.

The electrical connectors 100, 1100, 2100 may comprise further signal pins 310, 320, 330, 340, 350, 360, 370, 380 and grounding pins 210, 220, 230. It is preferred that the signal pins 310, 320, 330, 340, 350, 360, 370, 380 are grouped in differential signal pairs 410, 420, 430, 440 and that the signal pairs 410, 420, 430, 440 are separated by grounding pins 210, 220, 230.

Figure 7:
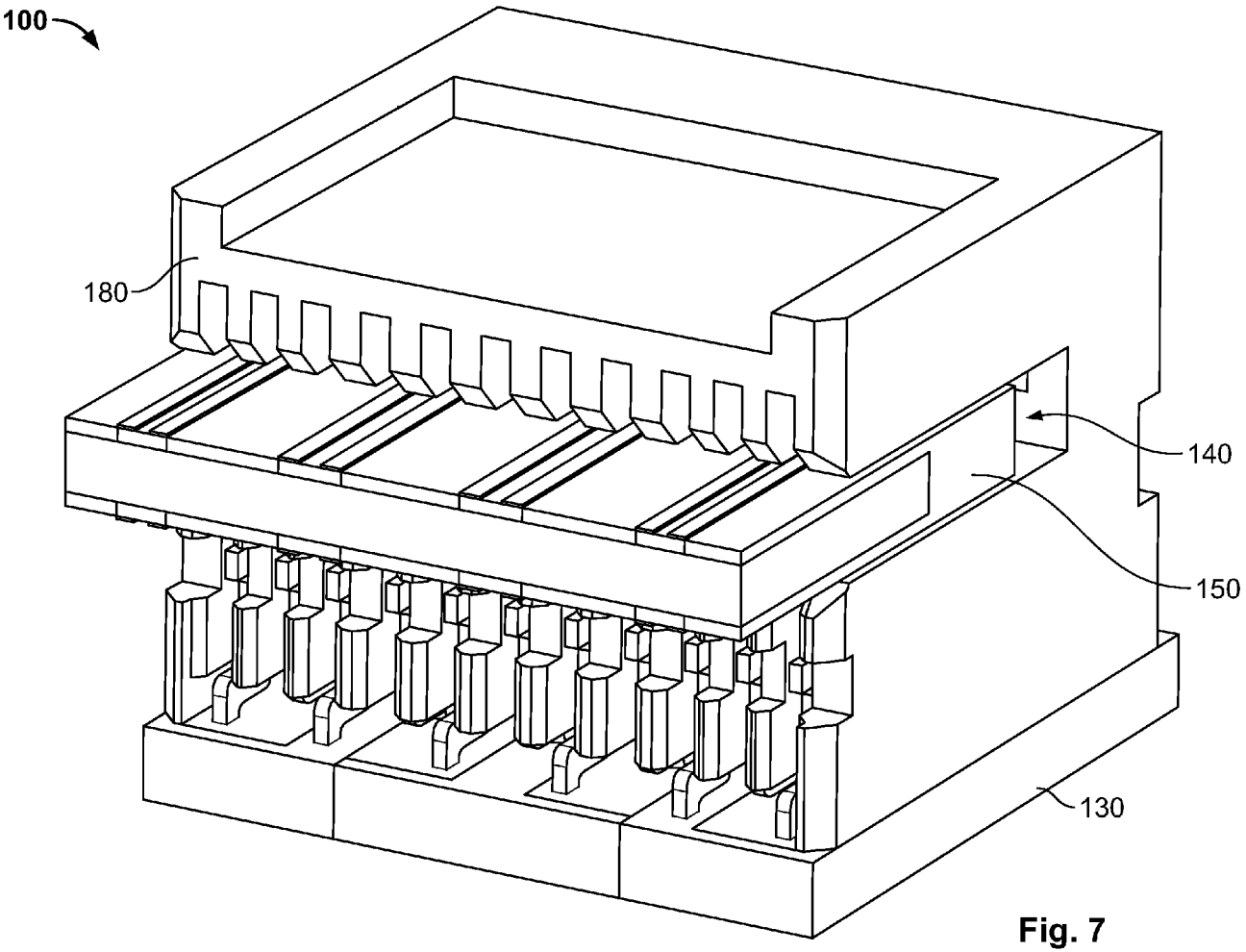
FIG. 7 shows a further depiction of an electrical connector according to the invention.

FIG. 7 shows a further schematic depiction of the first electrical connector 100. In FIG. 7, the first electrical connector 100 is shown with a connector housing 170. The connector housing 170 may for example be formed of plastic material. The connector housing 170 comprises a cover section 180. The cover section 180 may comprise metallic spring elements that form the grounding bars 240, 250, 260, 270, 280 of the first row 110 of contact pins of the first electrical connector 100. The metallic spring elements are arranged in the cover section 180 in such a way that the metallic spring elements are pressed onto the grounding pins 210, 220, 230 when the first electrical connector 100 is mounted in the connector housing 170 with the cover section 180.

The invention claimed is:

1. An electrical connector comprising a first row of contact pins, wherein said first row of contact pins comprises a first grounding pin, a second grounding pin and a first signal pin arranged between said first grounding pin and said second grounding pin, wherein a plurality of grounding bars electrically connect said first grounding pin and said second grounding pin.

2. The electrical connector according to claim 1, wherein said grounding bars span said first signal pin.

3. The electrical connector according to claim 1, wherein said grounding bars are arranged perpendicular to an extension direction of said contact pins.

4. The electrical connector according to claim 1, wherein said grounding bars are electrically isolated from said first signal pin.

5. The electrical connector according to claim 1, wherein said grounding bars are made from stamped material.

6. The electrical connector according to claim 1, wherein said grounding bars are formed integrally with said first grounding pin and/or said second grounding pin.

7. The electrical connector according to claim 1, wherein said connector comprises a housing, wherein said housing comprises a section made of plastic material, wherein said grounding bar is formed by a conductive element enclosed in said section.

8. The electrical connector according to claim 1, wherein a second signal pin is arranged between said first grounding pin and said second grounding pin, wherein said first signal pin and said second signal pin are designed for forming a differential signal pair.

9. The electrical connector according to claim 1, wherein a second grounding bar of the plurality of grounding bars electrically connects said first grounding pin and said second grounding pin.

10. The electrical connector according to claim 9, wherein said second grounding bar is arranged in parallel to said grounding bar.

11. The electrical connector according to claim 1, wherein said row of contact pins further comprises a third grounding pin, wherein said grounding bars electrically connect said first grounding pin, said second grounding pin and said third grounding pin.

12. The electrical connector according to claim 1, wherein said row of contact pins further comprises a third grounding pin, wherein plural grounding bars electrically connect said first grounding pin and second grounding pin and plural grounding bars connect said second grounding pin and said third grounding pin.

13. The electrical connector according to claim 12, wherein said plural grounding bars electrically connecting said first grounding pin and second grounding pin and said plural grounding bars connecting said second grounding pin and said third grounding pin are arranged at different longitudinal positions of said second grounding pin.

14. The electrical connector according to claim 1, wherein the connector comprises a second row of pins arranged in parallel to said first row of contact pins.

15. The electrical connector according to claim 1, wherein the connector is adapted for contacting an edge connector.

* * * * *